US009606470B2

(12) United States Patent
Soda

(10) Patent No.: US 9,606,470 B2
(45) Date of Patent: Mar. 28, 2017

(54) IMAGE FORMING APPARATUS WITH CURRENT DETECTION WHEN PHOTOCONDUCTOR IS RE-CHARGED

(71) Applicant: CANON KABUSHIKI KAISHA, Tokyo (JP)

(72) Inventor: Shota Soda, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/996,856

(22) Filed: Jan. 15, 2016

(65) Prior Publication Data

US 2016/0209772 A1 Jul. 21, 2016

(30) Foreign Application Priority Data

Jan. 19, 2015 (JP) ..... 2015-007954

(51) Int. Cl.
*G03G 15/02* (2006.01)
*G03G 15/00* (2006.01)
*G03G 21/08* (2006.01)

(52) U.S. Cl.
CPC ..... *G03G 15/0283* (2013.01); *G03G 21/08* (2013.01); *G03G 15/80* (2013.01)

(58) Field of Classification Search
CPC .... G03G 15/0283; G03G 15/80; G03G 21/08; G03G 21/0094
See application file for complete search history.

(56) References Cited

U.S. PATENT DOCUMENTS

2002/0041767 A1* 4/2002 Saito ..... G03G 21/1889 399/44
2009/0169227 A1* 7/2009 Kanai ..... G03G 15/0266 399/128
2013/0136499 A1* 5/2013 Kamiyama ..... G03G 21/08 399/128
2014/0044443 A1* 2/2014 Hanamoto ..... G03G 15/0889 399/27

FOREIGN PATENT DOCUMENTS

JP 2009042738 A 2/2009

* cited by examiner

*Primary Examiner* — Sandra Brase
(74) *Attorney, Agent, or Firm* — Canon USA, Inc. IP Division

(57) ABSTRACT

When attachment of an unused photoconductor unit is detected, a mode is executed in which, during non-image formation, a first current flowing in a charging roller is detected when a photoconductor is re-charged without irradiation of light by a pre-exposure device after being charged and passing through a transfer position during non-image formation, and a second current flowing in the charging roller is detected when the photoconductor is re-charged with irradiation of light by the pre-exposure device after being charged and passing through the transfer position, and a current supplied to an LED lamp during image formation is controlled in accordance with detection results.

6 Claims, 14 Drawing Sheets

FIG. 9

| CHARGING CURRENT IN PRE-EXPOSURE OFF (μA) | 0 | -1 | -2 | -3 | -4 | -5 | -6 | -7 | -8 | -9 | -10 | -11 | -12 | -13 | -14 | -15 | -16 | -17 | -18 | -19 | -20 |
|---|---|---|---|---|---|---|---|---|---|---|---|---|---|---|---|---|---|---|---|---|---|
| TARGET VALUE OF CHARGING CURRENT (μA) | I0 | I1 | I2 | I3 | I4 | I5 | I6 | I7 | I8 | I9 | I10 | I11 | I12 | I13 | I14 | I15 | I16 | I17 | I18 | I19 | I20 |

FIG. 14

| CHARGING CURRENT IN PRE-EXPOSURE OFF (μA) | 0 | -1 | -2 | -3 | -4 | -5 | -6 | -7 | -8 | -9 | -10 | -11 | -12 | -13 | -14 | -15 | -16 | -17 | -18 | -19 | -20 |
|---|---|---|---|---|---|---|---|---|---|---|---|---|---|---|---|---|---|---|---|---|---|
| CORRECTION COEFFICIENT OF PRE-EXPOSURE CURRENT | X0 | X1 | X2 | X3 | X4 | X5 | X6 | X7 | X8 | X9 | X10 | X11 | X12 | X13 | X14 | X15 | X16 | X17 | X18 | X19 | X20 |

IMAGE FORMING APPARATUS WITH CURRENT DETECTION WHEN PHOTOCONDUCTOR IS RE-CHARGED

BACKGROUND OF THE INVENTION

Field of the Invention

One disclosed aspect of the embodiments relates to an electrophotographic image forming apparatus.

Description of the Related Art

An image forming apparatus of a tandem system in which color image formation is conducted by transferring toner images, formed in image forming stations of a plurality of colors, in a superimposed manner to an intermediate transfer member has been proposed. In the image forming apparatus of a tandem system, when the toner transferred to the intermediate transfer member in an upstream station passes through a downstream station, a potential step may be caused on a surface of the photoconductor at a transfer portion of the downstream station. It is therefore known that a phenomenon of "ghost" in which the generated potential step appears in the image as a difference in density may occur.

A known example of a method for controlling the ghost is to remove residual charge of the photoconductor by causing a photoconductor surface after transfer to be irradiated with a pre-exposure device having a light source, such as LED.

There is a problem, however, that deterioration of the photoconductor is promoted due to repeated irradiation with light of the surface of the photoconductor by the pre-exposure device for a long period of time, and that image defects generating at the end of life of the photoconductor in a "DC charging system" in which charging is conducted when a DC voltage is applied to a charging roller may occur earlier. It is therefore required to reduce the amount of light to be emitted from the pre-exposure device as much as possible.

In some cases, the pre-exposure device and a guide member used as a path on which light output from the light source passes may be incorporated in a photoconductor unit which is detachable with the photoconductor. When an unused photoconductor unit is attached in this configuration, a distance between the guide member and the photoconductor or a positional relationship between the light source and the guide member may differ for each photoconductor unit. Therefore, when an unused photoconductor unit is attached, the amount of light received by the surface of the photoconductor, emitted from the pre-exposure device, may vary due to an influence of individual difference of the photoconductor unit. It is therefore required to adjust the amount of light emitted from the pre-exposure device to be as small as possible and to be an appropriate amount.

Japanese Patent Laid-Open No. 2009-42738 discloses a method for setting an amount of light for exposure appropriate for controlling occurrence of ghost. In the method, a charging current flowing through a surface of a photoconductor after irradiation of the surface of the photoconductor by the pre-exposure device is detected, and an amount of light for exposure appropriate for controlling occurrence of ghost is set in accordance with the detection result.

In the image forming apparatus, a resistance value of the intermediate transfer member, the transfer roller, and the like may vary due to deterioration of long time use or environmental change, and a potential of the photoconductor after transfer may be changed.

The present inventors have found that, even in a case where the resistance value of the intermediate transfer member, the transfer roller, and the like is varied, and the potential of the photoconductor after transfer is changed, ghost can be controlled if the photoconductor could receive a predetermined constant amount of light from the pre-exposure device.

In the image forming apparatus described above, however, if the amount of light for pre-exposure at the time of image formation is set in accordance with the current flowing in the charging means as disclosed in Japanese Patent Laid-Open No. 2009-42738, a changed amount of the current due to the changed potential of the photoconductor after transfer caused by a change in resistance of the intermediate transfer member, the transfer roller, and the like is contained in the current flowing in the charging means. There is therefore a problem that an amount of light of the pre-exposure device could not be set to be appropriate.

SUMMARY OF THE INVENTION

One disclosed aspect of the embodiments provides an image forming apparatus capable of decelerating the progress of deterioration of a photoconductor.

An embodiment also provides an image forming apparatus including: a rotatable photoconductor; a charging unit configured to charge the photoconductor at a charging position when applied a DC voltage; a charging power supply configured to apply the DC voltage to the charging unit; a current detection unit configured to detect a charging current flowing in the charging unit; a toner image forming unit configured to form a toner image on a surface of the photoconductor charged by the charging unit; a transfer unit configured to transfer the toner image formed on the photoconductor by the toner image forming unit by applying transfer voltage to member to be transferred in transfer position; a transfer power supply configured to apply the transfer voltage to the transfer unit; an irradiation unit provided with a light source outputting light corresponding to input, and a guide member guiding the light output from the light source to arrive at the surface of the photoconductor, configured to irradiate the surface of the photoconductor with the light output from the light source at an irradiation position downstream of the transfer position and upstream of the charging position in a rotational direction of the photoconductor; and a control unit configured to control the input in the light source during image formation in which the toner image is formed by the toner image forming unit, wherein when an unused unit is attached, the control unit executes the following mode in which the control unit detects a first current that flows in the charging unit by the current detection unit when the surface of the photoconductor charged at the charging position passes through the transfer position with the transfer voltage being applied to the transfer unit, the surface of the photoconductor passes through the irradiation position without irradiation of light by the irradiation unit, and the surface of the photoconductor which passed through the irradiation position is re-charged at the charging position, and the control unit detects a second current that flows in the charging unit by the current detection unit when the surface of the photoconductor charged at the charging position passes through the transfer position with the transfer voltage being applied to the transfer unit, the surface of the photoconductor passes through the irradiation position with irradiation of light by the irradiation unit, and the surface of the photoconductor which passed through the irradiation position is re-charged at the charging position, and the control unit controls the input with respect to the light source during the image formation based on the first current and the second current detected in the mode.

Further features of the disclosure will become apparent from the following description of exemplary embodiments with reference to the attached drawings.

BRIEF DESCRIPTION OF THE DRAWINGS

FIG. 9 illustrates an exemplary look-up table which stores target values.

FIG. 14 illustrates exemplary look-up table which stores correction coefficients according to another embodiment.

DESCRIPTION OF THE EMBODIMENTS

Figure 1:
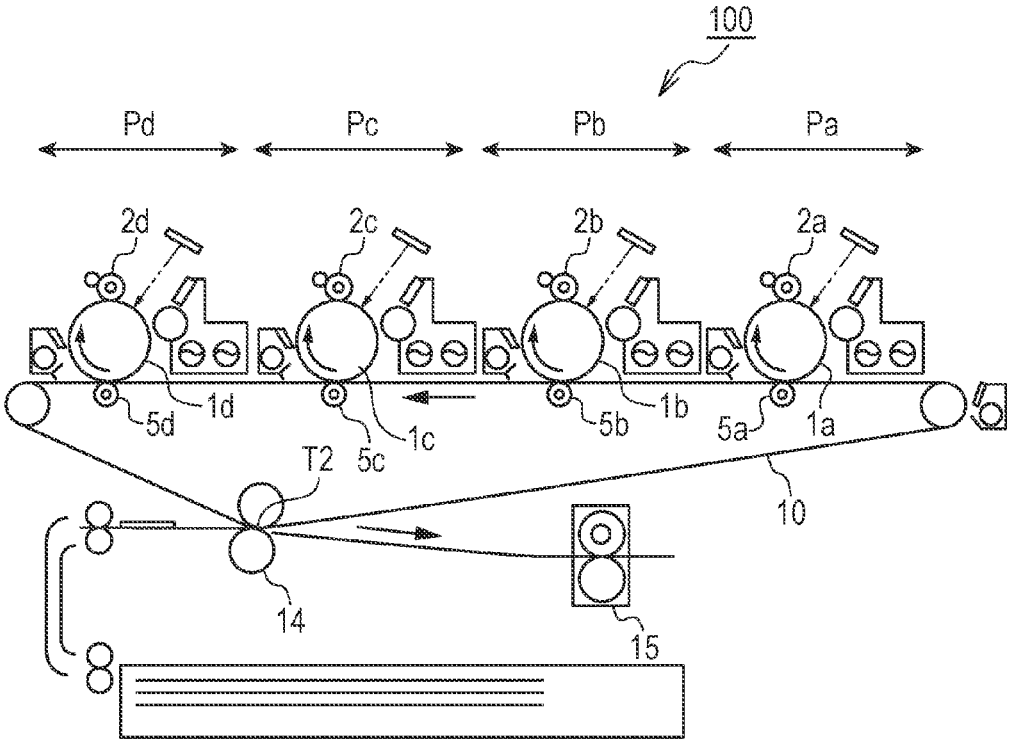
FIG. 1 illustrates a configuration of an image forming apparatus.

Hereinafter, embodiments of the disclosure are described in detail with reference to the drawings. Components denoted by the same reference numerals have the same configuration or operation, and are not described repeatedly. The application range of this technical idea is not limited to dimensions, materials, shapes, relative positions, and the like of the components unless otherwise specified.

First Embodiment

A schematic structure of an electrophotographic image forming apparatus illustrated in FIG. 1 is described. FIG. 1 is a schematic cross-sectional view of the image forming apparatus.

The image forming apparatus of the present embodiment is a full-color image forming apparatus of a tandem system provided with four drum-shaped photoconductors 1*a*, 1*b*, 1*c*, and 1*d* as image bearing members.

The image forming apparatus is provided with four image forming units Pa, Pb, Pc and Pd, each of which forms yellow, magenta, cyan, and black toner image, respectively.

Figure 2:
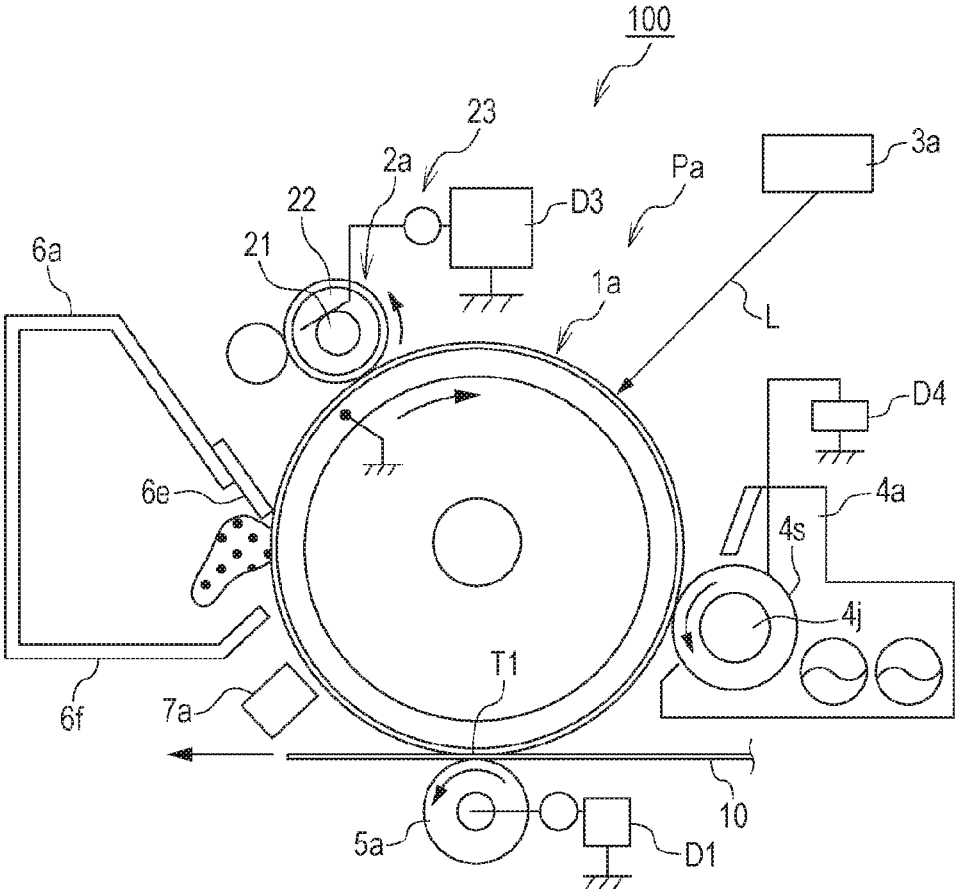
FIG. 2 illustrates a configuration of an image forming unit.

Since the image forming units Pa, Pb, Pc and Pd are substantially the same in structure, the image forming unit Pa is described in detail as an example in FIG. 2 and subsequent drawings, and other image forming units are not described in detail.

The reference numeral 1*a* denotes a photoconductor as a member to be charged. The photoconductor 1*a* is an organic photoreceptor in which a photoconductive layer of organic substances and a surface protection layer are laminated in this order on a conductive support. Fluororesin fine particles are contained in the surface protection layer. The photoconductor 1*a* of the present embodiment is formed by 1-mm-thick aluminum layer as the conductive support. The photosensitive layer and the surface protection layer laminated on the aluminum layer. The photoconductor 1*a* has therefore an outer diameter of 30 mm.

The photoconductor 1*a* is rotatable in the arrow direction in FIG. 1 about a rotation axis by driving force of an unillustrated motor at a predetermined peripheral speed.

An image exposure device 3*a* (3*b*, 3*c*, 3*d*), a developing device 4*a* (4*b*, 4*c*, 4*d*), a transfer roller 5*a* (5*b*, 5*c*, 5*d*), a cleaning device 6*a* (6*b*, 6*c*, 6*d*), and a pre-exposure device 7*a* are provided on the periphery of the photoconductor 1*a*. An intermediate transfer belt (ITB) 10 as an intermediate transfer member, which is a member to be transferred, is provided between the photoconductor 1*a* and the transfer roller 5*a*. The intermediate transfer belt 10 is movable and temporarily bears toner images transferred from each of the image forming units until the toner images are transferred to a sheet as a recording material by a secondary transfer roller 14.

A charging roller 2*a* (2*b*, 2*c*, 2*d*) (i.e., a charging rotary member) as a charging means is disposed to be in contact with the photoconductor 1*a*. The charging roller 2*a* is in contact with the photoconductor 1*a* to uniformly charge a surface of the photoconductor 1*a* to a predetermined potential. The position to be charged by the charging roller 2*a* is referred to as a charging position. The photoconductor 1*a* charged by the charging roller 2*a* in the charging unit exposed (L) in accordance with image information by the image exposure device 3*a* as an exposure means, and an electrostatic latent image based on the image information is formed on the surface of the photoconductor 1*a*.

The electrostatic latent image formed on the surface of the photoconductor 1*a* is developed with toner as a developer by the developing device 4*a* as a developing means, and is made visible when a toner image is formed on the surface of the photoconductor 1*a*. The image exposure device 3*a* as the exposure means and the developing device 4*a* as the developing means constitute a toner image forming means.

Then, the toner image (i.e., a yellow toner image) formed on the surface of the photoconductor 1*a* is transferred by the transfer roller 5*a* (i.e., a primary transfer roller) to the intermediate transfer belt 10 as the intermediate transfer member formed of polyimide-based resin at a transfer position T1. The transfer roller 5*a* is a transfer means (i.e., a primary transfer means) to which a transfer voltage (i.e., transfer bias) is applied from a power supply D1 as a transfer power supply.

The image formation process described above is conducted similarly to the image forming units Pb to Pd, and the yellow toner image, a magenta toner image, a cyan toner image, and a black toner image are finally transferred to the intermediate transfer belt 10 in a superimposed manner. Then a full color toner image on the intermediate transfer member 10 is secondarily transferred collectively to the sheet which is the recording material at a transfer portion T2 by the secondary transfer roller 14 as the secondary transfer means.

The full color toner image transferred to the sheet is heated and pressurized in a fixing device 15 to be fixed to the sheet. The sheet is then discharged outside the apparatus and a series of image formation process is completed.

Transfer residual toner remaining on the photoconductor 1 after primary transfer is removed by a cleaning blade 6*e*, which rubs against the photoconductor and is collected to a collected toner container 6*f*. The cleaning blade 6*e* is provided in the cleaning device 6*a* as a cleaning means illustrated in FIG. 2.

The potential remaining on the surface of the photoconductor after primary transfer is discharged when the surface of the photoconductor is irradiated with light from the pre-exposure device as an irradiation means at an irradiation position after the primary transfer.

Charging Roller

The charging roller 2*a* has a conductive core metal 21 which is a shaft as a base, and an elastic layer 22 disposed on the core metal 21.

The conductive core metal 21 may be formed of a metallic material, such as iron, copper, stainless steel, and aluminum. Aluminum is used in the present embodiment. The conductive core metal 21 may be plated for the rust prevention or damage resistance in a range not to impair conductivity.

The elastic layer 22 of the charging roller 2*a* is formed by rubber (ethylene propylene diene rubber (EPDM)) which is an elastic material in which carbon black as a conducting agent is dispersed. Therefore, resistance of the elastic layer 22 is adjusted to less than $10^{10}$ Ωcm, and the elastic layer has electrical conductivity. The conducting agent may be an electronically conductive agent, such as graphite and conductive metallic oxide, or an ionically conductive agent, such as alkali metal salt. The elastic material may be natural rubber, synthetic rubbers, such as SBR, silicone rubber, urethane rubber, epichlorohydrine rubber, IR, BR, NBR and CR, polyamide resin, polyurethane resin, and silicon resin.

The diameter of the conductive core metal 21 of the charging roller 2*a* of the present embodiment is 8 mm. Resistance of the charging roller 2*a* is adjusted to $1\times10^6$ Ωcm by adding a conducting agent to the elastic layer. The outer diameter of the charging roller 2*a* is 14 mm.

A power supply D3 as a charging power supply which applies a charging bias as a charging voltage to the core metal 21, and an ammeter 23 as a current detection means which detects DC (i.e., a charging current) flowing in the charging roller 2*a* at that time are connected to the charging roller 2*a*. The image forming apparatus of the present embodiment employs a DC charging system, and the power supply D3 applies only a DC voltage as the charging bias. The DC voltage value is a value equal to or greater than a discharge starting voltage at which discharging is started between the charging roller 2*a* and the photoconductor 1*a*, and is a value obtained by adding a desired charged potential on a normal charging polarity side of the photoconductor to the discharge starting voltage. The surface of the photoconductor 1*a* is charged to a desired potential by discharging caused between the charging roller 2*a* and the photoconductor. In the present embodiment, the charging bias is a DC voltage of −1200V, the discharge starting voltage is −600V and the surface of the photoconductor 1*a* is charged to −600V. In the present embodiment, the ammeter 23 as a current detection means can detect a DC component through time resolution (i.e., can detect a DC component with respect to a time axis). Time resolution herein is at least 5 msec, and desirably 1 msec or less.

It is known that, when image formation is repeatedly conducted in the image forming apparatus and the life of the image forming apparatus becomes shorter, the photoconductive layer of the photoconductor is ground due to friction caused by the cleaning blade and the thickness of the photoconductive layer is reduced. As the thickness of the photoconductor 1*a* is reduced, a discharge starting voltage between the charging roller 2*a* and the photoconductor 1*a* decreases. If a constant voltage is applied continuously to the charging roller 2*a* even after the thickness of the photoconductor 1*a* is reduced, a surface potential may increase depending on the reduced amount of the thickness. It is therefore desirable to control the DC voltage applied to the charging roller 2*a* to be a value according to the thickness of the photoconductor. The resistance value of the charging roller 2*a* varies due to a change in temperature or moisture content in the atmosphere. Also in this case, if a constant voltage is applied continuously to the charging roller 2*a* even after the resistance value of the charging roller 2*a* varied, a surface potential of the photoconductor 1*a* may vary. In particular, if the temperature decreases, the resistance value of the charging roller 2*a* increases and the surface potential after charging decreases. If the temperature increases or the moisture content in the air increases, the resistance value of the charging roller 2*a* decreases and the surface potential after charging increases. It is therefore desirable to provide a temperature sensor or a temperature and humidity sensor as an environment detection means in an apparatus main body to control the DC voltage applied to the charging roller 2*a* to be values in accordance with the temperature and the moisture content detected by the temperature sensor or the temperature and humidity sensor. Therefore, even if the thickness and the environment, such as temperature and moisture content, change, the potential of the photoconductor after charging can be kept constant.

In the present embodiment, the charging roller 2*a* is urged by a spring against the photoconductor 1*a* at predetermined contact pressure. The charging roller 2*a* is rotated following the rotation of the photoconductor 1*a*.

The disclosure is not limited to the configuration in which the charging roller 2*a* is rotated following the rotation of the photoconductor 1*a*. Alternatively, the charging roller 2*a* may be driven to rotate by a motor, a gear and the like.

Developing Device

A two-component developer is used as a developing agent in the developing device 4*a* as the developing means (i.e., a developing unit). The developing device 4*a* agitates the two-component developer to charge the same, causes the two-component developer to be borne by a developing sleeve 4*s* rotating in the opposite direction of the rotational direction of the photoconductive drum 1*a* around a fixed magnetic pole 4*j*, and causes the two-component developer on the developing sleeve 4*s* to rub the surface of the photoconductive drum 1*a*. A vibration voltage in which an AC voltage is superimposed on a negative DC voltage is applied to the developing sleeve 4*s* as a development voltage (i.e., a development bias) from a development power supply (i.e., a development high pressure power supply) D4, which is an exemplary development voltage applying means. Therefore, negatively charged toner transfers to an image area of the electrostatic image on the photoconductive drum 1*a* which has become relatively positive as compared with the developing sleeve 4*s* is, and the electrostatic image on the photoconductive drum 1*a* is developed. That is, toner charged to the charging polarity of the photoconductor (in the present embodiment, negative) adheres to an exposed portion on the photoconductor (image portion exposure, reversal development). The absolute value of the potential in the exposed portion has been decreased by being charged uniformly and then exposed. The two-component developer is formed by mixing a magnetic carrier with an average particle diameter of 50 μm, nonmagnetic toner with an average particle diameter of 6 μm, and predetermined external additives. In the rotational direction of the photoconductive drum 1*a*, a position on the photoconductive drum 1*a* at which the photoconductive drum 1*a* faces the developing sleeve 4*s* (i.e., a position where the two-component developer contacts) is the developing unit.

Figure 3:
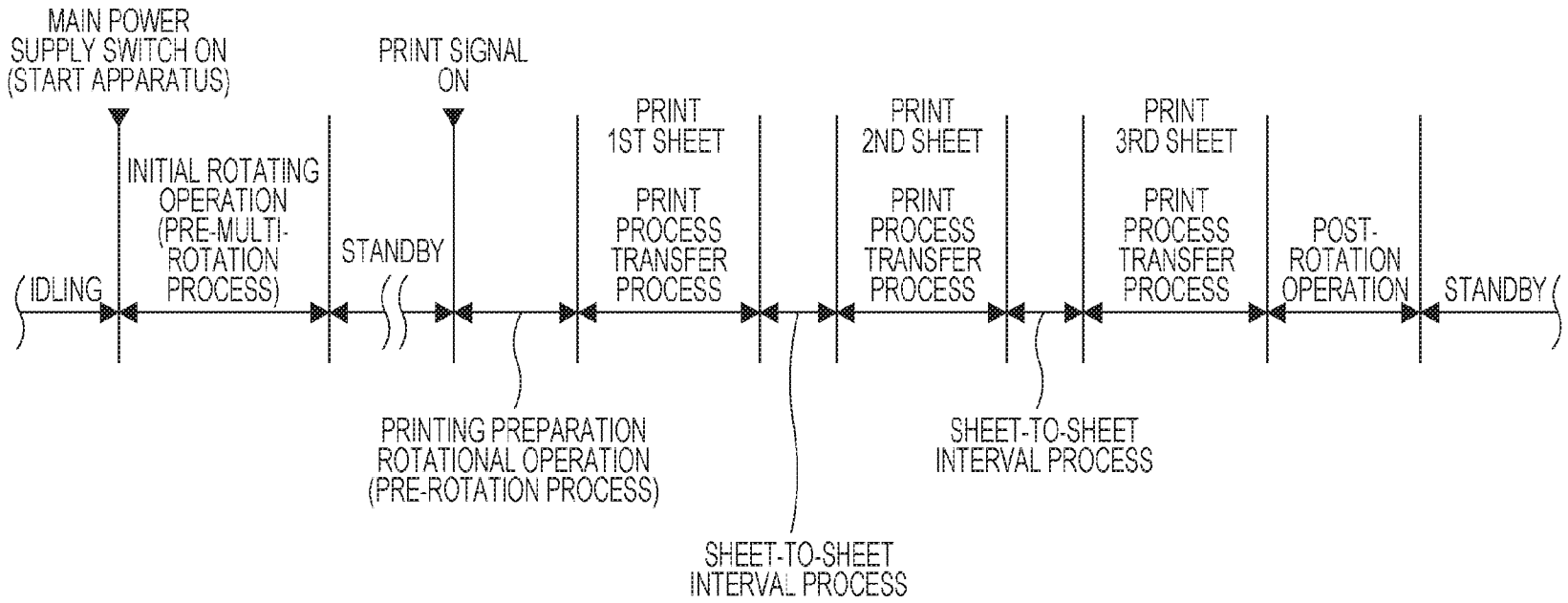
FIG. 3 illustrates an operation sequence of the image forming apparatus.

FIG. 3 illustrates an operation sequence of the image forming apparatus of the present embodiment.

a. Initial Rotating Operation (Pre-Multi-Rotation Process)

In this period, a starting operation of the image forming apparatus (i.e., a start operation, a warming operation) at the time of starting up is conducted. In particular, a period in which a power supply switch (not illustrated) of the image forming apparatus is turned on to start the image forming apparatus, and the photoconductive drum is rotated to become a "print-ready" state in which image formation is possible. In this period, preparatory operations of predetermined process units, such as various initial checks of the image forming apparatus, detection of residual toner amount, density adjustment, starting of the fixing device 15 to a predetermined temperature, are conducted.

b. Printing Preparation Rotating Operation (Pre-Rotation Process)

This is a period of a preparatory operation of image formation, since a print signal (i.e., an image formation start instruction) is turned on until an image formation process (i.e., a print process) is conducted. When a print signal is input during the initial rotating operation, the printing preparation rotating operation is conducted after the initial rotating operation. If no print signal is input during the initial rotating operation, driving of a main motor is temporarily stopped after the end of the initial rotating operation and rotation of the photoconductor 1*a* is stopped. Then the image forming apparatus is kept at a standby state until a print signal is input. When a print signal is input, a printing preparation rotating operation is conducted.

c. Print Process (Image Formation Process, Imaging Process)

When the predetermined printing preparation rotating operation is completed, an imaging process to the photoconductor 1*a* is conducted. In the imaging process, the toner image formed on the surface of the photoconductor 1*a* is transferred to the sheet, the toner image is fixed by the fixing device 15, and the like and the image-formed matter is printed. In a continuous printing mode, the print process is repeatedly conducted for a predetermined number of print sheets.

d. Sheet-to-Sheet Interval Process

This is a period corresponding to a non-passing condition of a sheet in a transfer portion T2 in the continuous printing mode, i.e., a period since a trailing end of one sheet passes through a transfer portion T2 until a leading end of a subsequent sheet arrives at the transfer portion T2.

e. Post-Rotation Operation

This is a period in which a predetermined preparation (i.e., arrangement) operation is conducted in a state in which driving of the main motor is continued for a while after the print process of the last sheet is completed and the photoconductor 1*a* is driven to rotate.

f. Standby

When the predetermined post-rotation operation is completed, driving of the main motor is stopped and rotation of the photoconductor 1*a* is stopped. Then the image forming apparatus is kept in a standby state until a following print signal is input. When only one sheet is to be printed, the image forming apparatus becomes a standby state after the post-rotation operation when the print is completed. In the standby state, when a print signal is input, the image forming apparatus conducts the printing preparation rotating operation.

The print process (c) corresponds to the image formation period. The initial rotating operation (a), the printing preparation rotating operation (b), and the sheet-to-sheet interval process (d), and the post-rotation operation (e) correspond to the non-image formation period. The post-rotation operation (e) corresponds to the process after the image formation is completed.

Occurrence of Ghost

Figure 4:
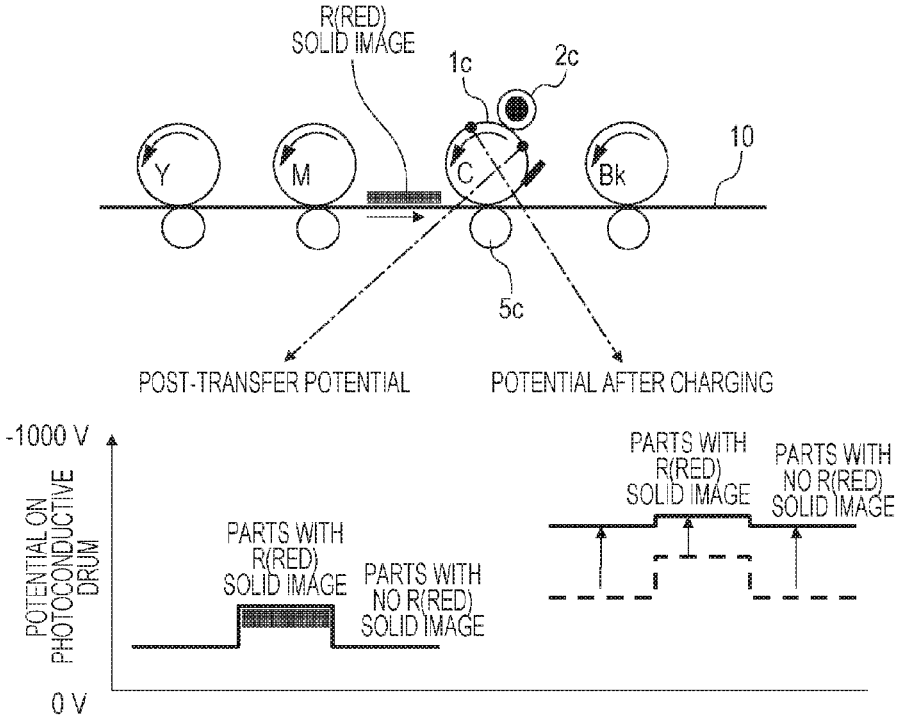
FIG. 4 illustrates a ghost.

In an image forming apparatus of a tandem system provided with an intermediate transfer member, suppose that, for example, a red solid image is formed in the yellow and magenta image forming units which are upstream image forming units as illustrated in FIG. 4. Then, if a halftone image is to be formed in the cyan image forming unit which is a downstream image forming unit, a phenomenon occurred that, after a red solid image formed on the intermediate transfer belt 10 passed through the transfer position T1 in the cyan image forming unit, a cyan halftone image formed after one peripheral rotation of the cyan photoconductor 1*c* became partially lighter.

This phenomenon is described with reference to FIG. 4. As illustrated in FIG. 4, the red solid image formed in the yellow image forming unit Pa and the magenta image forming unit Pb of FIG. 1 is conveyed by the intermediate transfer belt 10 until arriving at the transfer position T1 which is the transfer position of the photoconductor 1*c* of the cyan image forming unit and the transfer roller 5*c*. The red solid image then passes through the transfer position T1 of the cyan image forming unit.

In the graph of FIG. 4, the vertical axis represents a negative potential on the photoconductor 1*c* after the red solid image passes. A portion where the red solid image existed (passed) has a higher potential on the photoconductor 1*c* after transfer on the negative side compared with a portion where no red solid image existed (passed) when the same transfer voltage (positive voltage) is applied. This is because the toner of the red solid image functions as a resistor when the red solid image passes through the transfer portion T1 of the cyan image forming unit, a current when applied the same transfer bias in the cyan image forming unit becomes small, and the potential of the photoconductor 1*c* after transfer is not sufficiently lowered.

The photoconductor 1*c* is charged by the subsequent charging roller 2*c*, but the potential after transfer difference remains slightly in the potential after charging as history, and appears as nonuniformity in the toner image formed on the cyan photoconductor 1*c*. This phenomenon is called a ghost.

As described above, the ghost is a phenomenon in which the toner image transferred to the intermediate transfer member in the upstream image forming unit of a tandem system causes a difference in the potential of the downstream photoconductor at the transfer position of the downstream image forming unit. The ghost occurs more frequently if the toner amount per unit area formed in the intermediate transfer member in the upstream image forming unit is larger. In the present embodiment, since, for example, red is formed from yellow and magenta, the toner amount of the portion at which the toners of a plurality of colors overlap influences cyan and black images. Similarly, since green is formed from yellow and cyan, the toner amount of the portion at which the toners of a plurality of colors overlap or the toner amount of the portion at which the toners of a plurality of colors in which blue is formed with magenta and cyan influence a black image.

Pre-Exposure Device

To control occurrence of the ghost, the image forming apparatus of the present embodiment is provided with a pre-exposure device 7 (i.e., a pre-charging exposure device) as an irradiation means which exposes the surface of the photoconductor 1*a* after the primary transfer with light and discharges the charge remaining on the surface of the photoconductor 1*a*.

Figure 5:
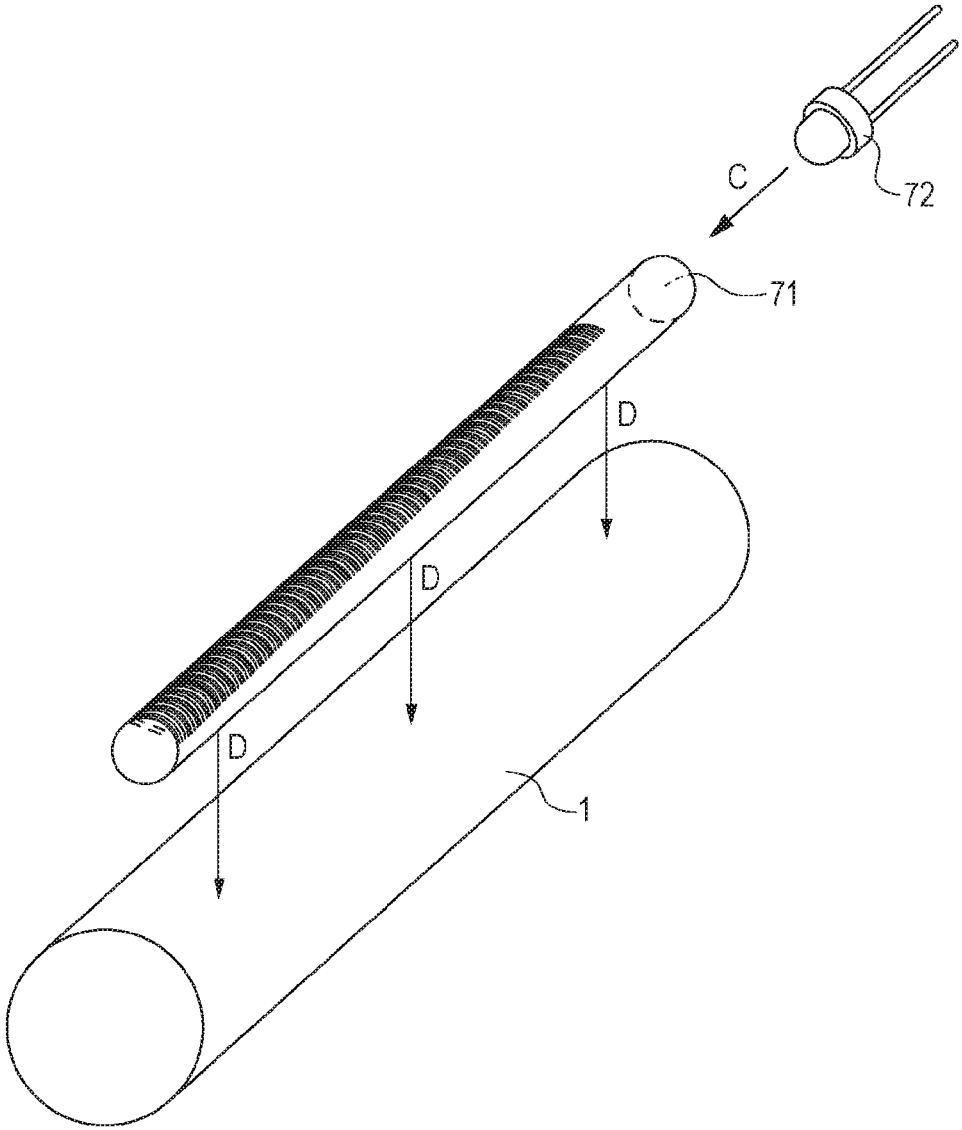
FIG. 5 illustrates a configuration of a pre-exposure device.

FIG. 5 illustrates a configuration of a pre-exposure device.

After the primary transfer, residual charge remaining on the surface of the photoconductor 1*a* is removed by the pre-exposure device 7*a* which emits light at the irradiation position of the downstream of the transfer position T1 and the downstream of the charging position in the rotational direction of the photoconductor 1*a*. The pre-exposure device 7*a* is located in the upstream of the cleaning blade 6*e* in the rotational direction of the photoconductor 1*a* illustrated in FIG. 2. The pre-exposure device 7*a* emits light from an LED lamp 72 as a light source disposed at an end of a light guide 71 as a guide member (arrow C in FIG. 5), and the light entered the light guide 71 is reflected on a side surface of the light guide 71 and moves toward the surface of the photoconductor (arrows D in FIG. 5). The surface of the photoconductor 1 is irradiated with the light reflected on the side surface of the light guide 71, and the surface potential of the photoconductor 1*a* is discharged. The light guide 71 may be formed by high light transmittance resin (e.g., acrylics, polycarbonate, and polystyrene), glass, and the like. Although one LED lamp 72 is provided at a position to face one of end surfaces of the light guide 71 in the present embodiment, two LED lamp 72 may be provided so that each of which faces each of the end surfaces of the light guide if, for example, the light amount is insufficient.

Although the same pre-exposure device is provided in each of the image forming units Pb to Pd, detailed description is omitted.

In the present embodiment, the photoconductor 1*a*, the charging roller 2*a*, and the cleaning device 6*a* constitute a photoconductor unit which is detachably attached to the image forming apparatus body, and the light guide 71 which constitutes the pre-exposure device 7*a* is incorporated as a part of the photoconductor unit. The LED lamp 72 which constitutes the pre-exposure device 7*a* is fixed to the image forming apparatus body. When the photoconductor unit is detached from the image forming apparatus, the light guide 71 incorporated in the photoconductor unit is also detached from the LED lamp. That is, when the photoconductor 1*a* has reached its end of life and the photoconductor unit is replaced with a new unused photoconductor unit, the light guide 71 is also replaced with a new light guide 71, but the LED lamp 72 provided outside the unit is not replaced.

There are variation among individual photoconductor units regarding a distance between the light guide 71 and the photoconductor 1*a*, the light guide characteristics of the light guide 71, the reflection characteristics of the side surface, the position at which the light guide and the LED on the side of the image forming apparatus body are assembled, and the like. Therefore, when the photoconductor unit is replaced as described above, due to the influence of the variation among individual photoconductor units, the amount of light per unit time applied to the surface of the photoconductor (per unit area) may vary even if the LED is lit with the current supplied to the LED to be the same current value per unit time. Then, if a light path from the light source of the pre-exposure device to the surface of the drum is changed as in the present embodiment, it is necessary to set the input in the LED lamp 72, i.e., a current supplied to the LED lamp 72, so that the amount of light per unit time applied to the surface of the photoconductor (per unit area) is not changed due to the influence of the variation.

Figure 6:
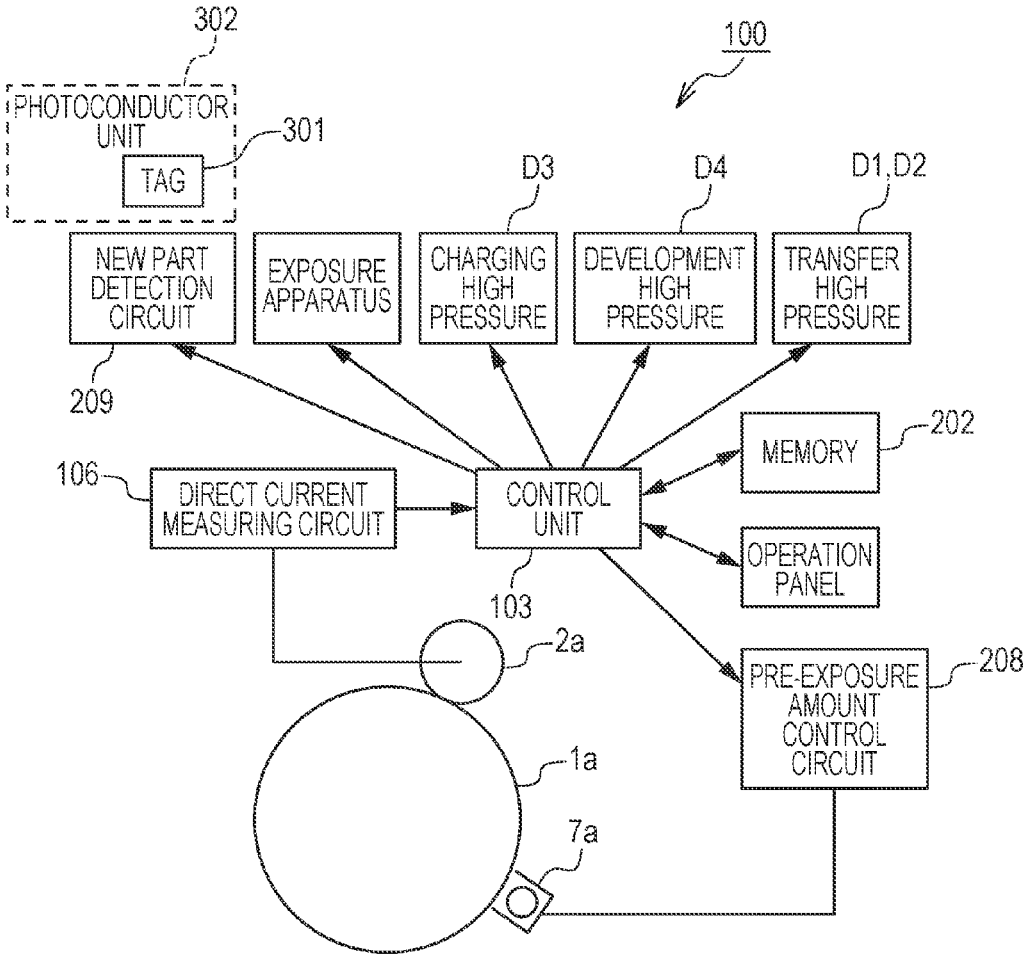
FIG. 6 is a block diagram of components near a control unit.

FIG. 6 is a block diagram illustrating a schematic control mode of a main part of the image forming apparatus 100 in the present embodiment. In FIG. 6, the reference numeral 1*a* denotes the photoconductor, 2*a* denotes the charging roller, and 7*a* denotes the pre-exposure device.

In accordance with the environmental conditions and durable conditions, a control unit 103 as a control means determines output conditions of a charging high voltage power supply D3 as a charging power supply which applies a charging bias to the charging roller, a development high pressure power supply D4 as a development power supply which applies a development bias to the developing device 4*a*, a transfer high pressure power supply D1 as a transfer power supply (i.e., a primary transfer power supply) which applies a transfer bias to the transfer roller 5*a*, a transfer high pressure power supply D2 as a secondary transfer power supply which applies a secondary transfer bias to the secondary transfer roller 14, and the LED lamp 72 as the light source in the pre-exposure device 7, and outputs the output conditions at predetermined timing in image formation and adjusting operation.

The output of the charging high voltage power supply D3 is applied to the charging roller 2*a*. The charging current flowing in the charging roller 2*a* at that time is detected by a DC measurement circuit 106 as a detection unit, and the detection result is returned to the control unit 103.

Figure 7:
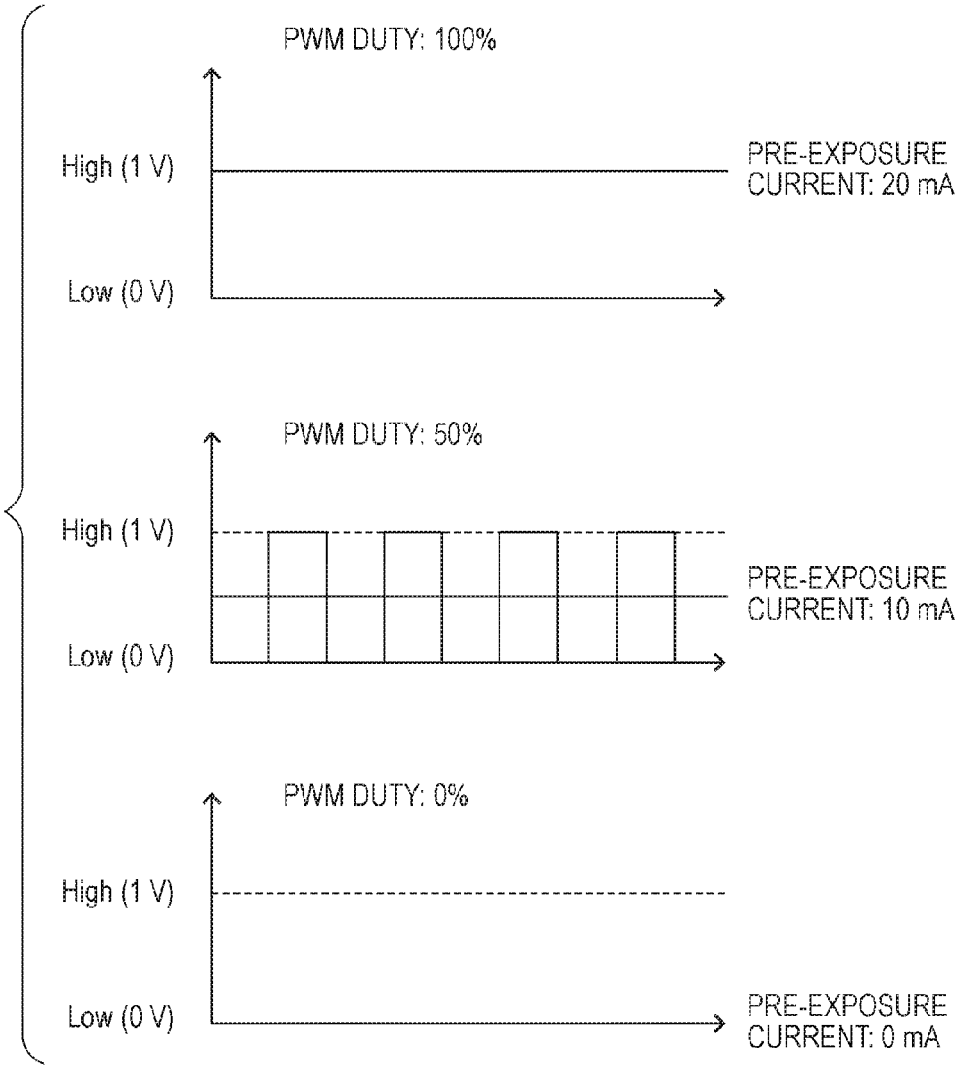
FIG. 7 illustrates pulses applied to an LED lamp.

Since the control unit 103 sets the current which a pre-exposure amount control circuit 208 supplies to the LED lamp 72, the LED lamp 72 in the pre-exposure device 7*a* emits light at a predetermined light amount. With PWM control, the pre-exposure amount control circuit 208 may be controlled so that the current (average current) supplied to the LED lamp 72 per unit time as the pre-exposure current to be 0 mA to at most 20 mA. Specifically in the present embodiment, as illustrated in FIG. 7, a pulse voltage of peak value 1V and a bottom value of 0V is applied to the LED lamp 72. The LED lamp 72 is lit when the pulse voltage is High (i.e., the peak value), and the LED lamp 72 is turned off when the pulse voltage is Low (0V). As the ratio of High in one period increases, the current supplied to the LED lamp 72 increases. In the present embodiment, the current flowing in the LED lamp 72 is 20 mA when the voltage of 1V which is a High period of the pulse voltage is being applied to the LED lamp 72, and the current flowing is 0 mA, i.e., no current flows, when the voltage of 0V which is a Low period of the pulse voltage is being applied to the LED lamp 72. The pre-exposure current in the present embodiment corresponds to the average value of the current flowing in one period. As the ratio of the High period in one period of the pulse voltage increases (i.e., as PWM duty increases), the value of the pre-exposure current increases and, as the ratio of the High period in one period of the pulse voltage decreases (i.e., as PWM duty decreases), the value of the pre-exposure current decreases. The pre-exposure current of the LED lamp 72 and the light amount output per unit time are in a linear relationship, and the pre-exposure current and the PWM duty are in a linear relationship. Specifically, when the PWM duty is 0%, the pre-exposure current is 0 mA and, when the PWM duty is 100%, the pre-exposure current is 20 mA. In the present embodiment, the period in which the PWM duty is 0% corresponds to the period in which the LED lamp 72 is turned off. However, the LED lamp 72 may lit if its output is so weak that the potential of the surface of the photoconductor is not affected, and that the photoconductor is not irradiated substantially.

Memory 202 as a storage means temporarily stores the direct current (i.e., the charging current) flowing in the charging roller 2*a* detected in the pre-exposure amount control (i.e., PWM duty control) described later.

A new part detection circuit 209 as a replacement detection unit is a circuit which detects that an unused photoconductor unit has been attached to the apparatus main body. Although attachment of an unused photoconductor unit is detected by reading information on a tag 301 including memory provided in the photoconductor unit 302 in the present embodiment, this method is not restrictive. Alternatively, for example, in a configuration in which a fuse element provided in the photoconductor unit is energized and blown when the image forming apparatus is started with an unused (new) photoconductor unit being attached, attachment of the unused photoconductor unit may be detected when the fuse element is energized. If no element, such as tag or fuse, is provided in the photoconductor unit, in a configuration in which an operator pushes a predetermined switch when he or her attaches an unused photoconductor unit, attachment of the unused photoconductor unit may be detected by detecting that the switch has been pushed. When the new part detection circuit 209 detects replacement of the photoconductor unit, the pre-exposure amount control described later is conducted.

Pre-Exposure Amount Control

Figure 8:
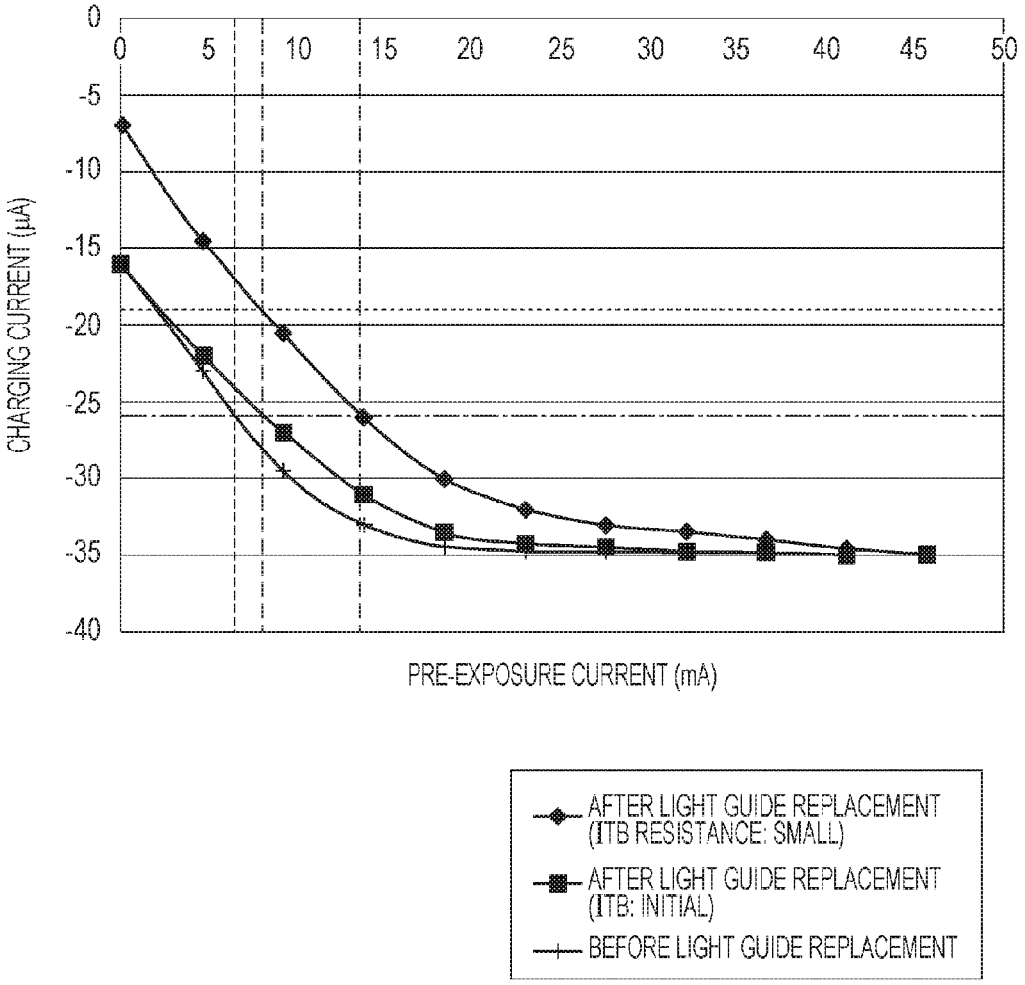
FIG. 8 illustrates a relationship between a pre-exposure current and a charging current in pre-exposure amount control.

FIG. 8 is a graph illustrating a relationship between the direct current (i.e., the charging current) flowing in the charging roller 2*a* when the charging voltage is applied, and the pre-exposure current as the input supplied to the LED lamp 72. As illustrated in FIG. 8, as the pre-exposure current increases, the value of the charging current increases. The charging current varies with the potential difference between the charging roller 2*a* and the surface of the photoconductive drum 1*a* facing the charging roller 2*a* before charging.

For example, a case where charging bias of −1200V is applied to the charging roller 2*a* to uniformly charge the photoconductor 1*a* to −600V will be considered. The surface of the photoconductor is charged to −600V by the charging roller 2*a*, and the photoconductor 1*a* is made to passes through the transfer position T1 by the transfer roller 5*a* at which the transfer bias +1000V has been applied. After the photoconductor 1*a* passed through the transfer position T1, if the pre-exposure current is 0 mA, i.e., if no light is emitted from the pre-exposure device, the potential of the photoconductor 1*a* becomes about −300V before being re-charged by the charging roller 2*a* after passing through the transfer position T1. Therefore, the potential difference between the charging roller 2*a* and the surface of the photoconductor 1*a* which faces the charging roller 2*a* becomes 300V, which is the difference between the −300V and −600V, and the charging current which flows at this time is about −16 μA. If the pre-exposure current is set to 20 mA, the potential of the surface which faces the charging roller 2*a* before being re-charged becomes about 0V, and the difference of 600V becomes the potential difference, which causes the charging current of about −35 μA to flow. As described above, if the discharge exposure current is 0 mA or close to 0 mA, the potential remains on the photoconductor 1*a* after the primary transfer, and the above-described ghost often occurs.

On the other hand, if the pre-exposure current is set to be greater than an appropriate current value, occurrence of ghost can be reduced, but the photoconductive drum may deteriorate easily, and an image with stripe-shaped nonuniformity in density (hereafter referred to as a "charging horizontal stripe") caused by nonuniformity in surface potential of the photoconductor in the longitudinal direction (i.e., a direction crossing substantially perpendicularly the circumferential direction) of the photoconductor is generated. It is therefore important to set the value of the light amount output per unit time by the LED lamp 72 to be as smallest as possible, i.e., to set the pre-exposure current value to be as smallest as possible.

Even if the current (i.e., the pre-exposure current) supplied to the LED lamp 72 is controlled to be the same value as that before replacement after the photoconductor unit is replaced and an unused photoconductor unit is attached as described above, variation may occur in the light amount per unit area applied to the surface of the photoconductor in a predetermined period. Then, if a light path from the light source of the pre-exposure device to the surface of the drum is changed, the following pre-exposure amount control has been conducted conventionally to set the current supplied to the LED lamp 72 so that the light amount per unit area applied to the surface of the photoconductor in a predetermined period does not change due to the influence of the variation.

As illustrated in FIG. 8, since variation occurs in the light amount per unit time applied to the surface of the photoconductor (per unit area) before and after the replacement of the photoconductor unit, the value of the charging current which flows when the photoconductor is re-charged by the charging roller 2 later becomes different even if the same pre-exposure current is supplied to the LED lamp 72.

Then, in the related art pre-exposure amount control, the charging current value at which the ghost disappears is stored in a storage means, such as the memory 202, as a target value, the charging current is measured with various pre-exposure currents supplied to the LED lamp 72 when the photoconductor unit is replaced, and a pre-exposure current at which the charging current becomes the target value is obtained and is set as the pre-exposure current used for the image formation.

In the present embodiment, the charging current at which the ghost disappears is found by an experiment to be about −26 μA in combination of the photoconductor and the intermediate transfer member in the initial stage of life.

It has been found that, however, in the case where the image forming apparatus of a tandem system provided with the intermediate transfer belt 10 is used, the control described above is conducted when the photoconductor unit is replaced after the life of the image forming apparatus became shorter from the initial use, the following problem may occur.

Figure 10:
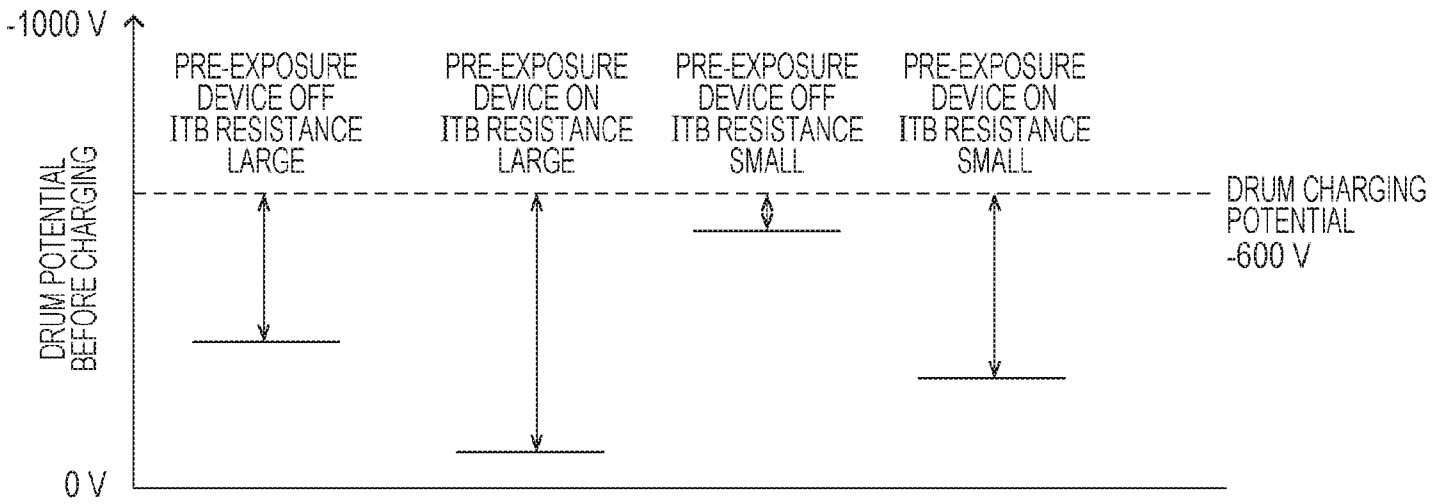
FIG. 10 illustrates a relationship between potentials of photoconductor surface before and after charging under various conditions.

FIG. 10 illustrates a relationship between a photoconductor surface and a potential before charging under various conditions. The horizontal line in FIG. 10 represents the potential of the photoconductor before being re-charged after passing through transfer position T1 and the irradiation position by the pre-exposure device under each condition. The bidirectional arrow in FIG. 10 represents the potential difference from the potential −600V on the surface of the photoconductor after charging.

This problem is described with reference to FIGS. 8 and 10. It has been found that, as the life of the intermediate transfer belt 10 becomes shorter, the resistance value of the intermediate transfer belt decreases. As a result that the resistance value of the intermediate transfer belt 10 decreases, the ratio of the current flowing through the belt without flowing in the photoconductor 1*a* from the transfer roller 5*a* to which the transfer bias is applied, and not flowing in the photoconductor increases, and the ratio of the current flowing in the photoconductor 1*a* decreases. Therefore, the effect of discharging the surface potential of the photoconductor 1*a* at the transfer position T1 is reduced and, after the photoconductor surface passes the transfer portion, the potential of the photoconductor surface before charging becomes closer to the target potential to be charged later.

"Pre-exposure device: OFF/ITB resistance: large" in FIG. 10 represents a relationship of the potential of the photoconductor surface before charging in the case where no light irradiation by the pre-exposure device is conducted with the intermediate transfer belt 10 being a new condition. "Pre-exposure device: ON/ITB resistance: large" in FIG. 10 represents a relationship of the potential of the photoconductor surface before charging in the case where light irradiation on the photoconductor has been conducted by the pre-exposure device with the intermediate transfer belt 10 being a new condition. "Pre-exposure device: OFF/ITB resistance: small" in FIG. 10 represents a relationship of the potential of the photoconductor surface before charging when no light irradiation by the pre-exposure device is conducted in the case where the life of the intermediate transfer belt 10 has become shorter and the resistance value has become smaller. It is turned out that the potential difference between the charged potentials before and after charging has become smaller as compared with the case of "pre-exposure device: OFF/ITB resistance: large" in this case. "Pre-exposure device: ON/ITB resistance: small" in FIG. 10 represents a relationship of the potential of the photoconductor surface before charging when light irradiation by the pre-exposure device is conducted in the case where the life of the intermediate transfer belt 10 has become shorter and the resistance value has become smaller. It is turned out that the potential difference between the charged potentials before and after charging has become smaller as compared with the case of "pre-exposure device: ON/ITB resistance: large" also in this case.

Therefore, the potential difference between the charging roller 2*a* and the surface of the photoconductive drum 1*a* which faces the charging roller 2*a* decreases, and the charging current flowing in the charging roller 2*a* at the time of re-charging also decreases.

The present inventors have confirmed, by experiments, that the light amount per unit time applied to the surface (per unit area) of the photoconductor from the pre-exposure device required to reduce the ghost, as the resistance of the intermediate transfer belt 10 changed and the potential of the photoconductor after transfer changed. As a result, the inventors have confirmed that the ghost could be reduced with the same light amount as that required to reduce the ghost before the potential of the photoconductor after transfer changes, even if the charging current became smaller when the potential of the photoconductor after transfer changed.

The horizontal dash-dot line in FIG. 8 represents the charging current at which the ghost disappears is −26 μA when the ITB is in the initial condition. The horizontal dotted line in FIG. 8 represents the charging current at which the ghost disappears when the resistance value of the ITB in FIG. 8 decreased. In the example illustrated in FIG. 8, the pre-exposure current at which the charging current becomes −26 μA is 8 mA in the curve "after light guide replacement (ITB: initial)," and it is only necessary that the pre-exposure current is adjusted to 8 mA even if the resistance value of the intermediate transfer belt decreases.

In spite of this fact, when the related art pre-exposure amount control as described above is conducted in the state where the resistance value of the intermediate transfer belt 10 has decreased, the pre-exposure current value is set at which the detected charging current becomes −26 μA which is the target value, and a pre-exposure current value of 14 mA which is greater than the required pre-exposure current value is set. Therefore, an appropriate pre-exposure current is not able to be set. As a result, the surface of the photoconductor is excessively exposed and deterioration of the photoconductor may be accelerated.

Then, in the pre-exposure amount control of the present embodiment, a change in the potential of the photoconductor after transfer is measured by detecting the charging current which flows when charging is conducted by the charging roller 2*a* with no irradiation of light by the pre-exposure device, and a target value of the charging current is set in accordance with the detection result (i.e., the measurement result). FIG. 9 illustrates an exemplary look-up table which stores target value of the charging current. Target values I0 to I20 of the charging current corresponding to the charging currents which flow when charging is conducted while no pre-exposure irradiation is conducted are stored in the look-up table as illustrated in FIG. 9. At the time of pre-exposure amount control, the target value is set by referring to the look-up table. The target value to be set in consideration of a change in the current caused by a potential change after transfer due to a resistance decrease of the intermediate transfer belt 10, and the like, and is set to 18 μA in the example illustrated in FIG. 8. The value of the pre-exposure current to be set based on the target value is the same as that of the pre-exposure current (in the present embodiment, 8 mA) when it is assumed that there has been no change in the resistance of the intermediate transfer belt 10 which is the member to be transferred as described above.

In the pre-exposure amount control of the present embodiment, information corresponding to the relationship between the current (i.e., the pre-exposure current) as the input supplied to the LED lamp 72 of the pre-exposure device and the potential of the photoconductor irradiated light from the pre-exposure device is further measured. Specifically, a predetermined pre-exposure current is supplied to the LED lamp 72, and the charging current (the direct current) flowing through the charging roller 2*a* when the surface of the photoconductor irradiated with light at that time is re-charged is detected. After the mode of detecting the charging current is executed, the relationship between the current supplied to the LED lamp 72 and the charging current is obtained. Specifically, an expression of a curve of the charging current and the pre-exposure current at the time of executing the mode is obtained by calculation based on the detected charging current value.

Based on the measurement result, i.e., the obtained relationship between the current (the pre-exposure current) per unit time supplied to the LED lamp 72 and the charging current, the current (the pre-exposure current) as the input in the LED lamp 72 at which the charging current becomes the target value when the mode is executed is obtained, and set as the pre-exposure current for the image formation.

Hereinafter, a reason for which the ghost can be reduced with the amount of light for pre-exposure that has been necessary to reduce the ghost when the intermediate transfer belt 10 was its initial condition even after the resistance of the intermediate transfer belt 10 decreased is described.

When the resistance value of the intermediate transfer belt 10 decreases, the current flowing in the photoconductor 1*a* from the transfer roller 5*a* to which the transfer bias is applied becomes lower, and the effect to discharge the surface potential of the photoconductor 1*a* at the transfer position T1 is reduced. Therefore, after the photoconductor surface passes through the transfer position, the potential of the photoconductor surface before charging becomes closer to the target potential to be charged later. If only the potential relationship is considered, it is presumed that the light amount per unit time to be applied to the photoconductor 1*a* necessary to reduce the ghost increases.

However, since the current flowing in the photoconductor 1*a* from the transfer roller 5*a* becomes lower, the amount of toner of which polarity is inverted from negative which is the normal charging polarity of toner to positive in response to the current flowing toward the photoconductor at the transfer position decreases. Therefore, the amount of toner retransferred to the photoconductor at the transfer position decreases. As the amount of toner retransferred to the photoconductor 1*a* decreases, it is presumed that emission of light from the pre-exposure device to the surface of the photoconductor 1*a* will be less interfered with the toner, and that a greater amount of light emitted from the pre-exposure device arrives at the surface of the photoconductor 1*a*. Therefore, regarding the light amount per unit time applied to the photoconductor 1*a* necessary to reduce ghost, it is presumed that the effect of reducing ghost can be obtained by the same light amount as that before the resistance value of the intermediate transfer belt 10 changes.

Figure 11:
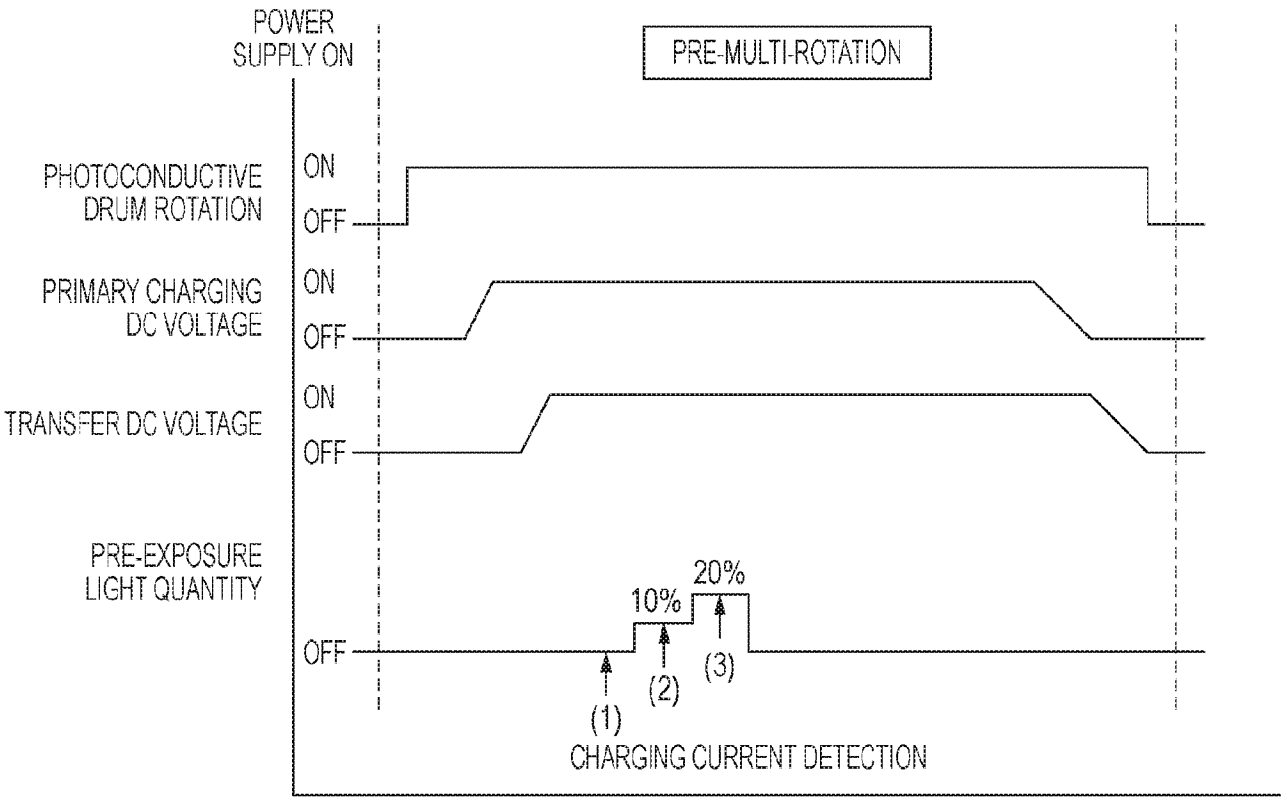
FIG. 11 is a timing chart related to pre-exposure amount control according to the present embodiment.
Figure 12:
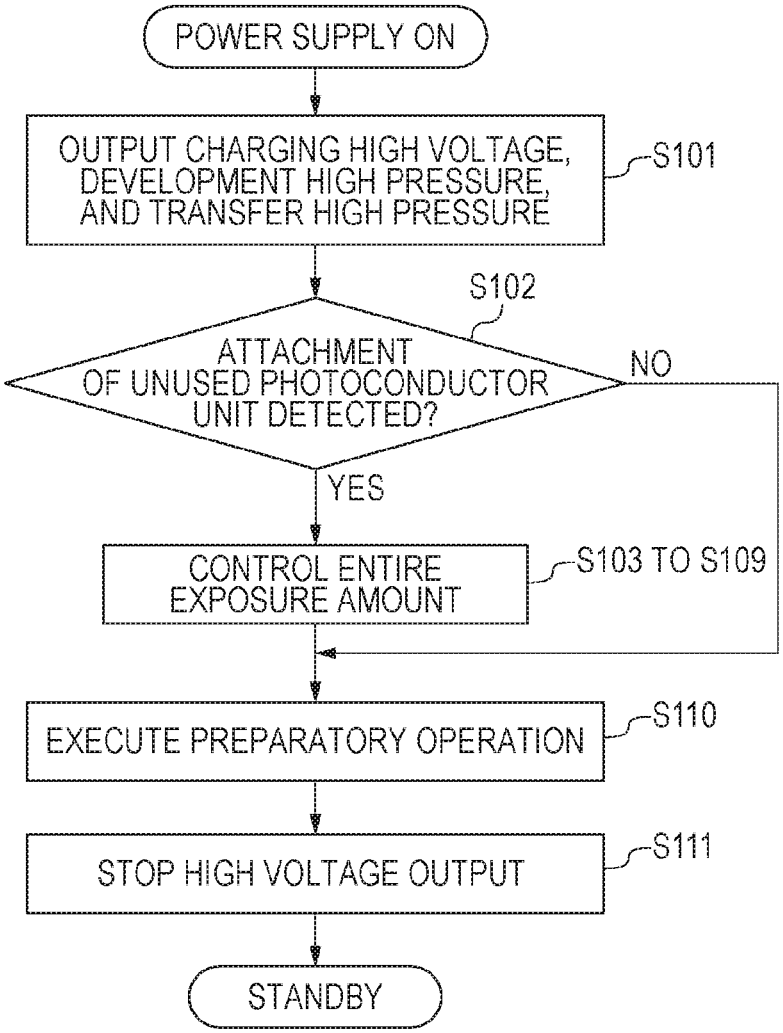
FIG. 12 is a flowchart related to an operation at the time of starting up of a power supply of the image forming apparatus according to the present embodiment.
Figure 13:
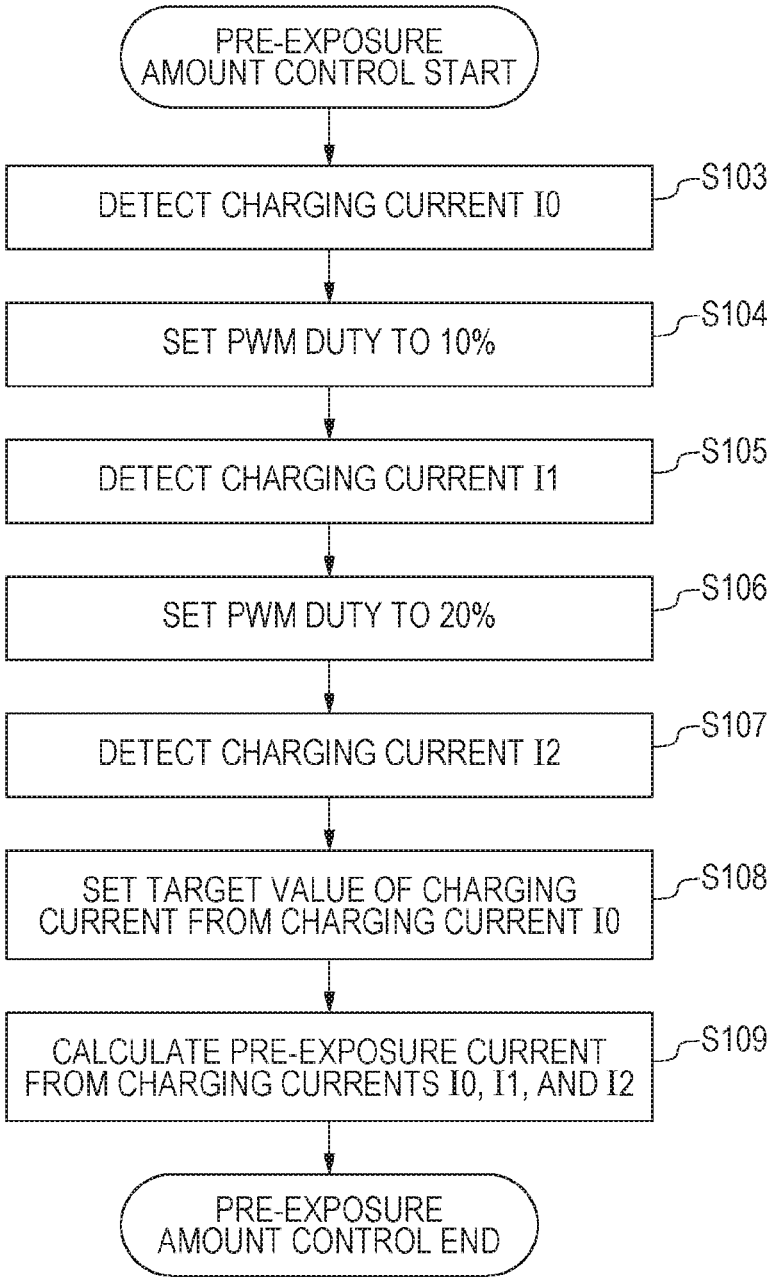
FIG. 13 is a flowchart related to pre-exposure amount control according to the present embodiment.

FIG. 11 is a timing chart when executing the pre-exposure amount control in the present embodiment. FIG. 12 is a flowchart related to an operation at the time of starting up of the power supply of the image forming apparatus. Specifically, FIG. 12 is a flowchart of a pre-multi-rotation process in which the control unit 103 as the execution unit executes the pre-exposure amount control. FIG. 13 is a flowchart of the pre-exposure amount control.

After the image forming apparatus is started by turning a unillustrated power switch ON, the control unit 103 starts rotation of the photoconductor and starts the pre-multi-rotation process. After the photoconductor 1*a* starts rotation, charging of the photoconductor 1*a* is started by starting application of the DC voltage as the charging bias to the charging roller 2*a*. In the present embodiment, the DC voltage applied to the charging roller is −1200V, and the potential of the charged photoconductor is −600V. As described above, the voltage applied to the charging roller 2*a* is adjusted so that the potential of the photoconductor after charging is set to −600V depending on the thickness and the environment, such as temperature and moisture content. After a predetermined period of time elapsed since charging is started, application of the development bias to the developing device is started, and application of the transfer bias to the transfer roller 5*a* is started (S101). Then, control called auto transfer voltage control (ATVC) for adjusting the voltage value of the transfer bias is conducted so that the current which flows in the transfer roller when the transfer bias is applied becomes a predetermined value, and the transfer bias to apply is determined. In the present embodiment, +1000V is applied as the transfer bias.

If attachment of an unused photoconductor unit is detected by the new part detection circuit 209 as the attachment detection unit (S102: Yes), the pre-exposure amount control is conducted in the period in which the pre-multi-rotation process is conducted (S103 to S109). In the present embodiment, the photoconductor unit is provided with a tag including memory as a storage unit which can store information input from the apparatus main body, and data corresponding to the pre-exposure current set in the pre-exposure amount control described later is written in the memory of the tag. In the present embodiment, the photoconductor unit in which data corresponding to the pre-exposure current set in the pre-exposure amount control described later is not written in the memory of the tag thereof is referred to as an unused photoconductor unit. In the present embodiment, in S102, attachment of an unused photoconductor unit is detected when the new part detection circuit 209 detects that no data corresponding to the pre-exposure current is written in the memory of the tag provided in the photoconductor unit. If the data corresponding to the pre-exposure current has been written in the memory of the tag provided in the photoconductor unit, various preparatory operations in the pre-multi-rotation process (S110) is executed without executing the pre-exposure amount control. In this configuration in which the data corresponding to the pre-exposure current set in the pre-exposure amount control is written in the tag provided in the photoconductor unit, the pre-exposure amount control is not necessary to perform when the photoconductor unit is removed from the apparatus main body for maintenance or the like, and then re-attached to the apparatus main body after the maintenance. Therefore, downtime can be shortened.

The pre-exposure amount control is described with reference to the flowchart of FIG. 13.

First, the charging current I0 (i.e., the first direct current) flowing in the charging roller 2*a* when the surface of the photoconductor 1*a* charged at −600V which is the predetermined potential passes through the transfer portion to which the transfer bias determined by the ATVC is applied, and is re-charged by the charging roller 2*a* without being irradiation with light by the pre-exposure device is detected (arrow 1 in FIG. 11) and stored in the memory 202 (S103).

Then, irradiation of light by the pre-exposure device is conducted with the PWM duty with respect to the surface of the photoconductor 1*a* which has been charged and has passed through the transfer portion being set to 10%, i.e., the pre-exposure current being set to 2 mA (S104). The charging current I1 (i.e., a second direct current) flowing in the charging roller 2*a* when the photoconductor is re-charged by the charging roller 2*a* is detected (arrow 2) and stored in the memory 202 (S105).

Then, irradiation of light by the pre-exposure device is conducted with the PWM duty with respect to the surface of the photoconductor 1*a* which has been charged and has passed through the transfer portion being set to 20%, i.e., the pre-exposure current being set to 4 mA (S106). The charging current I2 (i.e., a third direct current) flowing in the charging roller 2*a* when the photoconductor is re-charged by the charging roller 2*a* is detected (arrow 3) and stored in the memory 202 (S107).

Next, the control unit 103 sets the target value for setting the pre-exposure current in accordance with the charging current I0 detected by executing the mode described above (S108). Specifically, the control unit 103 refers to a look-up table as illustrated in FIG. 9, which is stored in, for example, the memory 202 to set the target value corresponding to the value of the detected charging current I0. In the look-up table, the value of the charging current I0 detected with no light irradiation by the pre-exposure device and the target value corresponding to the value are stored. The target value stored in the look-up table is, when the value of the charging current I0 detected with no light irradiation by the pre-exposure device changes, the value determined based on the data obtained by experiments in advance by causing the charging current flowing in the charging roller 2*a* when the photoconductor is re-charged in response to the irradiation of the amount of light by the pre-exposure device necessary to control the ghost to correspond to each charging current I0. That is, by setting the target value for setting the pre-exposure current with reference to the look-up table in accordance with the detected charging current I0, the influence on the pre-exposure amount control due to the change in potential of the photoconductor after transfer resulting from the change in the resistance value of the intermediate transfer belt 10 can be reduced.

Next, the control unit 103 calculates an approximated curve representing a relationship between the pre-exposure current and the charging current based on the charging current I0, the charging current I1, and the charging current I2 detected by executing the mode described above. The control unit 103 then obtains the pre-exposure current when the charging current becomes the target value in the calculated approximated curve, sets the obtained pre-exposure current as the input in the LED lamp 72 for the image formation, and writes the value of the set pre-exposure current in the tag of the photoconductor unit (S109).

After the pre-exposure amount control is completed, various preparatory operations in the pre-multi-rotation process are executed (S110). After the pre-multi-rotation process is completed, output from each high-voltage power supply is stopped, rotation of the photoconductor 1*a* is stopped (S111), and the image forming apparatus shifts to its standby state.

Then, during image formation, the light of the LED lamp 72 of the pre-exposure device 7 is lit at the PWM duty with the set pre-exposure current.

The pre-exposure amount control is executed in the pre-multi-rotation process because, since a plurality of adjustments and starting-up are performed partially in parallel in the pre-multi-rotation process, time for adjustments and starting-up performed in parallel is long and the entire time for the pre-multi-rotation process does not change even if the calculation of the pre-exposure current is performed. Alternatively, however, the pre-exposure amount control may be executed in, for example, a pre-rotation process.

In the pre-exposure amount control in the present embodiment, as described above, the voltage applied to the charging roller 2*a* is adjusted so that the potential of the photoconductor after charging is set to −600V depending on the thickness and the environment, such as temperature and moisture content. Therefore, the charged potential can be kept constant, varying of the charging current detected by the change in the resistance value of the charging roller 2*a* can be reduced, and the pre-exposure amount control can be executed highly accurately.

In the pre-exposure amount control in the present embodiment, as described above, the transfer bias determined by the ATVC is applied to the transfer roller. Therefore, an increase in variation of the potential of the photoconductor after transfer by the pre-exposure amount control can be reduced.

As described above, with the control of the present embodiment, progress of deterioration of the photoconductor can be decelerated while reducing ghost, even if the potential of the photoconductor after transfer is changed.

In the present embodiment, even when the resistance value of the intermediate transfer belt 10 has decreased, the light amount per unit time received by the photoconductor that is necessary to reduce ghost may be the same as the light amount when the intermediate transfer belt 10 is its initial condition. In a case, however, where the light amount per unit time received by the photoconductor that is necessary to reduce ghost when the resistance value of the intermediate transfer belt 10 becomes lower is the light amount different from that when the intermediate transfer belt 10 is its initial condition, the same pre-exposure amount control is applicable.

In this case, the target values stored in the look-up table are the value of the charging current obtained by experiment in advance by corresponding to the pre-exposure current necessary to reduce ghost when only the resistance value of the intermediate transfer belt 10 varies. Also in this case, the influence on the pre-exposure amount control due to the change in the resistance value of the intermediate transfer belt 10 can be reduced, and the same effect can be obtained.

Other Embodiments

Although an example in which the target value of the charging current stored in the look-up table is read directly in accordance with the charging current I0 is described in the first embodiment, this is not restrictive. A method of calculating a new target value by performing calculation using a coefficient may be used. In the method, the target value when the intermediate transfer belt 10 is in its initial condition is multiplied by, for example, a coefficient based on the charging current I0 to obtain a new target value. The same effect can be obtained in this case.

Although an example in which the target value of the charging current in the pre-exposure amount control is changed in accordance with the charging current I0 is described in the first embodiment, this is not restrictive. The value of the pre-exposure current obtained from the target value may be changed in accordance with the charging current I0 without changing the target value of the charging current. In this case, for example, correction coefficients X0 to X20 of the pre-exposure current are calculated with reference to the look-up table as illustrated in FIG. 14, the value of the pre-exposure current calculated from the target value is corrected, and the corrected pre-exposure current is set as the pre-exposure current for the image formation. In this case, the same effect as that of the first embodiment can be obtained.

In the first embodiment, the charging current I0 is detected where no light irradiation on the photoconductor is conducted by the pre-exposure device, and the charging current I1 and the charging current I2 are detected with two different amounts of light applied to the photoconductor by the pre-exposure device. However, the configuration above is not restrictive. Either of the charging current I1 or the charging current I2 may be detected with one amount of light applied to the photoconductor by the pre-exposure device. In this case, the approximated curve is obtained based on the charging current I0 and either of the charging current I1 or the charging current I2, whereby accuracy of the approximated curve is lowered, but the time required for the pre-exposure amount control can be shortened.

Although the environment and the thickness of the photoconductor are not described in the first embodiment, the image forming apparatus may be provided with an environment sensor as an environment detecting means which detects temperature, humidity, and moisture content, and a look-up table storing coefficients corresponding to parameters of the environment (temperature, humidity, and moisture content) where the image forming apparatus is installed. Information on the usage of the photoconductor, such as the thickness of the photoconductor, may be acquired, and a look-up table storing coefficients corresponding to the information may be provided. Acquisition of the information on the usage of the photoconductor herein not only includes detection of the thickness of the photoconductor, but includes acquisition of information on the number of sheets on which images are formed, rotation time of the photoconductor, charging time of the photoconductor, and the like. A look-up table storing both the information on the environment described above and the information on the usage of the photoconductor may be provided. In these cases, regarding the pre-exposure current obtained in the first embodiment, the coefficient based on the information acquired from the environment sensor provided in the image forming apparatus and the information on the usage of the photoconductor is acquired from the look-up table, and the pre-exposure current may be corrected through further calculation using the coefficient to the pre-exposure current set in the pre-exposure amount control in the first embodiment. With this configuration, the light amount of the pre-exposure device can be set more appropriately even if the environment or the thickness of the photoconductor is changed.

Although an example in which the light amount per unit time output from the LED lamp 72 is controlled by changing the PWM duty which makes the LED lamp 72 emit light is illustrated in the first embodiment, this configuration is not restrictive. For example, the current per unit time supplied to the LED lamp 72 may be controlled by controlling the value of the voltage or the value of the current applied to the LED lamp 72.

Although a configuration in which the photoconductor is charged with the charging roller 2*a* and the photoconductor being in contact with each other is described in the first embodiment, the disclosure is applicable also to a configuration in which the photoconductor is charged by discharging of the charging roller 2*a* which is located close to the photoconductor without contacting the photoconductor.

Although a case where the resistance value of the intermediate transfer belt is varied is described in the first embodiment, the disclosure is applicable also to a case where the potential of the photoconductor after transfer is varied when the entire resistance value including the resistance value of the transfer roller since the transfer bias is applied to the transfer roller until the transfer bias reaches the photoconductor. Therefore, progress of deterioration of the photoconductor can be decelerated while reducing ghost, even if the potential of the photoconductor after transfer is changed.

Although a configuration provided with the intermediate transfer belt is provided is described in the first embodiment, the disclosure is applicable also to a configuration in which an image is directly transferred to a sheet from the photoconductor. In that case, progress of deterioration of the photoconductor can be decelerated while reducing ghost, even if the potential of the photoconductor after transfer is changed due to a change in the resistance value of the conveying belt which conveys the sheet and the transfer roller.

According to the disclosure, progress of deterioration of the photoconductor can be decelerated while reducing ghost, even if the potential of the photoconductor after transfer is changed.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-007954, filed Jan. 19, 2015 which is hereby incorporated by reference herein in its entirety.

What is claimed is:

1. An image forming apparatus comprising:

a rotatable photoconductor;

a charging unit configured to charge the photoconductor at a charging position by applying a DC voltage;

a charging power supply configured to apply the DC voltage to the charging unit;

a current detection unit configured to detect a charging current flowing in the charging unit;

a toner image forming unit configured to form a toner image on a surface of the photoconductor charged by the charging unit;

a transfer unit configured to transfer the toner image formed on the photoconductor by the toner image forming unit by applying transfer voltage to member to be transferred in transfer position;

a transfer power supply configured to apply the transfer voltage to the transfer unit;

an irradiation unit provided with a light source outputting light corresponding to input, and a guide member guiding the light output from the light source to arrive at the surface of the photoconductor, and configured to irradiate the surface of the photoconductor with the light output from the light source at an irradiation position downstream of the transfer position and upstream of the charging position in a rotational direction of the photoconductor;

a photoconductor unit including at least the photoconductor and guide member, wherein the photoconductor unit is detachably attached to the image forming apparatus in a state where the light source is mounted on the image forming apparatus, a control unit configured to control the input in the light source during image formation in which the toner image is formed by the toner image forming unit, wherein when an unused photoconductor unit is attached, the control unit executes the following mode in which the control unit detects a first current that flows in the charging unit by the current detection unit when the surface of the photoconductor, which passed through the transfer position with the transfer voltage being applied to the transfer unit after charged at the charging position and passed through the irradiation position without irradiation of light by the irradiation unit thereafter, is re-charged at the charging position, and the control unit detects a second current that flows in the charging unit by the current detection unit when the surface of the photoconductor passed through the transfer position with the transfer voltage being applied to the transfer unit after charged at the charging position and passed through the irradiation position with irradiation of light by the irradiation unit thereafter, is re-charged at the charging position, and the control unit controls the input with respect to the light source during the image formation based on the first current and the second current detected in the mode, wherein the control unit sets the input during the image formation in which the second current in the mode becomes a target value which is set based on the first current.

2. The image forming apparatus according to claim 1, wherein the control unit sets the target value to a first target value when the first current is a first value and sets the target value to a second target value which is smaller than the first target value when the first current is a second value which is smaller than the first value.

3. The image forming apparatus according to claim 1, wherein in the mode, the control unit further detects a third current that flows in the charging unit by the current detection unit when the surface of the photoconductor, which passes through the transfer position with the transfer voltage being applied to the transfer unit after charged at the charging position passes through the irradiation position with irradiation of light, of which an amount is different from an amount of light in detecting the second current, by the irradiation unit, is re-charged at the charging position, and the control unit controls the input with respect to the light source during the image formation based on the first current, the second current, and the third current.

4. The image forming apparatus according to claim 1, further comprising an attachment detection unit configured to detect whether the unused photoconductor unit has been attached, wherein the control unit executes the mode when the attachment detection unit detects that the unused unit has been attached.

5. The image forming apparatus according to claim 1, wherein the photoconductor unit is provided with a storage unit capable of storing information input from an apparatus main body, and the control unit makes the storage unit store information corresponding to the input in the light source during the image formation set in accordance with the first current and the second current detected in the mode.

6. The image forming apparatus according to claim 1, wherein a member to be transferred is a movable intermediate transfer member configured to temporarily bear a toner image, provided with a second image forming unit that forms a toner image on a photoconductor upstream of a first image forming unit which has the photoconductor, the charging unit, the toner image forming unit, and the irradiation unit in a direction in which the intermediate transfer member moves, and configured to transfer the toner image formed by the first image forming unit superimposed on the toner image formed by the second image forming unit and transferred by the intermediate transfer member.

* * * * *